US005672561A

United States Patent [19]

Shinohara

[11] Patent Number: 5,672,561

[45] Date of Patent: Sep. 30, 1997

[54] INK RIBBON FOR THERMAL SUBLIMATION TRANSFER PROCESS

[75] Inventor: Satoru Shinohara, Miyagi, Japan

[73] Assignee: Sony Corporation, Tokyo, Japan

[21] Appl. No.: 474,149

[22] Filed: Jun. 9, 1995

[30] Foreign Application Priority Data

Jun. 17, 1994 [JP] Japan ..... 6-159238

[51] Int. Cl.[6] ..... B41M 5/035; B41M 5/38

[52] U.S. Cl. ..... 503/227; 156/235; 156/240; 156/241; 428/195; 428/447; 428/500; 428/913; 428/914

[58] Field of Search ..... 156/235, 240, 156/241; 8/471; 428/195, 913, 914, 447, 500; 503/227

[56] References Cited

U.S. PATENT DOCUMENTS 4,738,555 4/1988 Nagashima ..... 405/240

FOREIGN PATENT DOCUMENTS 0 201 940 11/1986 European Pat. Off. ..... 503/227

0 392 790 10/1990 European Pat. Off. ..... 503/227

0 429 666 6/1991 European Pat. Off. ..... 503/227

OTHER PUBLICATIONS

Patent Abstracts of Japan, vol. 007, No. 269 (M-259), Nov. 30, 1983 & JP-A-58 148778 (Sony KK) Sep. 3, 1983.

Patent Abstracts of Japan, vol. 016, No. 538 (M-1335), Nov. 9, 1992 & JP-A-04 201494 (Konica Corp.), Jul. 22, 1992.

*Primary Examiner*—Bruce H. Hess

*Attorney, Agent, or Firm*—Hill, Steadman & Simpson

[57] ABSTRACT

Disclosed is an ink ribbon for thermal sublimation transfer process having ink layer(s) 2 and laminate layer(s) 3 separately formed on one and the same surface of a substrate 1. The ink layer(s) 2 contains/contain a releasing resin, preferably a silicone-modified polyvinyl acetal resin, as the binder. The ink ribbon is applicable even to printing paper that has not been made releasable or has been made releasable but only slightly, while preventing the hot-sealing of the ink ribbon to the printing paper. The laminate layer(s) of the ink ribbon is/are uniformly transferred onto the dye-receiving layer of printing paper. FIG. 1 is referred to.

7 Claims, 2 Drawing Sheets

INK RIBBON FOR THERMAL SUBLIMATION TRANSFER PROCESS

BACKGROUND OF THE INVENTION

The present invention relates to an ink ribbon for thermal sublimation transfer process, which has ink layer(s) and laminate layer(s) to be a surface-protecting film to cover a transferred image, separately but on one and the same surface of a substrate.

Heretofore, a heat-transfer recording system has been widely employed in which an ink ribbon is heated with a thermal head or by lasers, etc. in accordance with image information, thereby transferring the dye from the ink ribbon to the dye-receiving layer of printing paper by thermal fusion, thermal diffusion or sublimation to form a color image on said dye-receiving layer. Recently, in particular, a so-called thermal sublimation transfer recording system has been noticed in which thermally-diffusing dyes such as subliming dyes, etc. are used to give full-color images with continuous gradations. For example, an attempt has been made at selectively heating a subliming heat-transfer ink ribbon in accordance with the image signal of a video image to thereby form an image on video printing paper.

An ink ribbon for thermal sublimation transfer process, such as that shown by FIG. 3*a*, is generally known, which has ink layers 2 formed on a substrate 1 made of, for example, a polyester or the like. Said ink layers 2 each are generally made of a solution (or dispersion) of a thermally-diffusing dye dissolved (or dispersed) in a binder resin. Recently, an ink ribbon such as that shown by FIG. 3*b* has become used, which has a laminate layer 3 composed of a releasing protective layer 3*a* and an adhesive layer 3*b*, formed on a substrate 1 separately from an ink layer 2. As in FIG. 4 which shows a printing paper 6 composed of a substrate 4 and a dye-receiving layer, the laminate layer 3 is transferred onto the surface of the dye-receiving layer 5 that has been imaged, so as to protect the color image formed in said layer 5. The transferring of the laminate layer 3 onto the layer 5 is conducted by heating the ink ribbon at the side of the substrate 1 with a thermal head or the like.

As the binder resin to be in the ink layer 2 of the subliming heat-transfer ink ribbon, polyvinyl acetal resins such as polyvinyl butyral resins, polyvinyl formacetal resins, polyvinyl acetacetal resins, etc. are popularly used in view of the compatibility of said resins with thermally-diffusing dyes, the density of images recorded, the heat resistance of said resins, etc. To form the releasing protective layer 3*a* of the laminate layer 3, used are resins releasable from the substrate 1 or from a primer layer (not shown) which is optionally provided on the substrate 1 so as to make the ink layer 2 adhered to the substrate 1, for example, acrylic resins, cellulosic resins, etc. To form the adhesive layer 3*b*, used are resins compatible with or adhesive to the resin constituting the dye-receiving layer of printing paper, for example, cellulosic resins, vinyl chloride-vinyl acetate resins, polyester resins, etc.

Where such a subliming heat-transfer ink ribbon is used in thermal sublimation transfer recording, it is necessary to prevent the heat sealing between the ink ribbon and printing paper under heat for recording.

In order to prevent such heat sealing, an attempt has heretofore been made at adding a releasing agent such as silicone oil or the like to the ink layer of a subliming heat-transfer ink ribbon, which, however, caused various problems in that the releasing agent added and thermally-diffusing dyes bled out and the dyes crystallized out.

Therefore, addition of a releasing agent such as silicone oil or the like to the dye-receiving layer of printing paper or formation of a release layer on the dye-receiving layer of printing paper by coating a silicone resin on said layer has been conducted.

However, if the dye-receiving layer of printing paper is made releasable by such means, there occurs a problem in that the laminate layer 3 of a subliming heat-transfer ink ribbon such as that shown by FIG. 3(*b*) becomes hardly transferable onto said dye-receiving layer. For this reason, it is extremely difficult to design the adhesive layer 3*b* of the laminate layer 3. In order to improve the adhesiveness between the laminate layer 3 and the dye-receiving layer that has been made releasable, the heat energy for transfer may be elevated. However, this causes another problem in that the color image formed is re-diffused in the dye-receiving layer to be blurred.

In addition, the distribution of the releasing agent in the dye-receiving layer of printing paper and also the distribution of the thickness of the release layer to be formed on the dye-receiving layer are often uneven on the same surface of one printing paper or on the surfaces of different printing papers, if the releasing treatments are conducted unevenly or if the printing papers are stored. If so, there occurs still another problem in that the adhesiveness of the adhesive layer 3*b* of the laminate layer 3 of a subliming heat-transfer ink ribbon onto the dye-receiving layer of the printing paper becomes uneven and therefore the laminate layer 3 transferred onto the dye-receiving layer is peeled off.

For these reasons, it has been desired to prevent the heat sealing between a sublimable heat-transfer ink ribbon and printing paper while omitting as much as possible the releasing treatment of the dye-receiving layer of printing paper.

SUMMARY OF THE INVENTION

The present invention is to solve the above-mentioned problems in the prior art, and its object is to provide a sublimable heat-transfer ink ribbon for thermal sublimation transfer recording process, which has ink layer(s) and laminate layer(s) formed separately on the same surface of one substrate. The ink ribbon can be applied even to printing paper which has not been made releasable or to printing paper which has been made releasable but only slightly, while preventing the heat sealing between the ink ribbon and the printing paper, and the laminate layer is uniformly transferred onto the image-receiving layer of the printing paper.

We, the present inventors have found that the above-mentioned object can be attained by using a releasing resin as the binder in the ink layer of a subliming heat-transfer ink ribbon and have completed the present invention.

Accordingly, the present invention provides an ink ribbon for thermal sublimation transfer process, which has ink layer(s) and laminate layer(s) formed separately on the same surface of one substrate and in which said ink layer(s) contains/contain a releasing resin as the binder resin.

BRIEF DESCRIPTION OF THE DRAWINGS

FIG. 1(*b*) is a plan view showing another embodiment of the subliming heat-transfer ink ribbon of the present invention for forming color images.

FIG. 1(*c*) is a plan view showing still another embodiment of the subliming heat-transfer ink ribbon of the present invention for forming color images.

FIG. 2(*b*) is an enlarged cross-sectional view showing another embodiment of the laminate layer of the subliming heat-transfer ink ribbon of the present invention.

FIG. 3(*b*) is a cross-sectional view showing another conventional subliming heat-transfer ink ribbon.

DETAILED DESCRIPTION OF THE INVENTION

The present invention is described in detail hereunder, with reference to the drawings attached hereto.

Figure 1A:
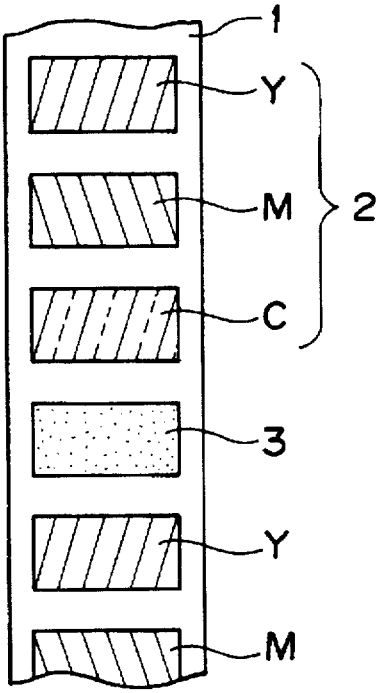
FIG. 1(*a*) is a plan view showing one embodiment of the subliming heat-transfer ink ribbon of the present invention for forming color images.
Figure 1B:
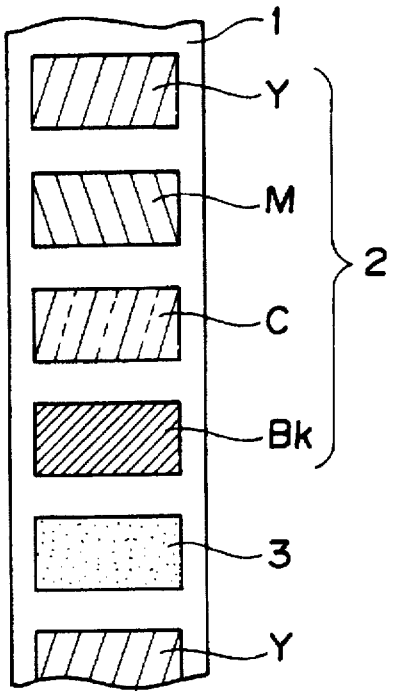
Figure 1C:
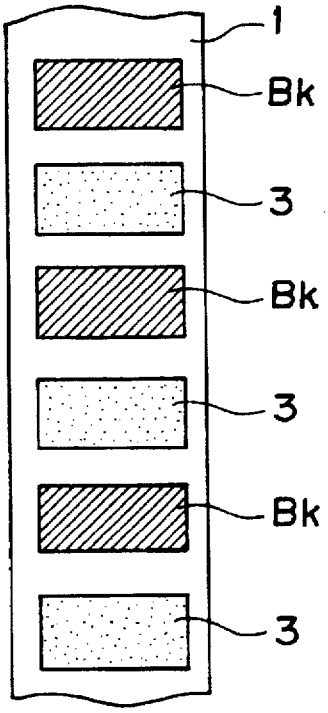

FIG. 1(*a*) is a plan view showing one embodiment of the subliming heat-transfer ink ribbon of the present invention for forming color images, which has ink layers 2 (yellow ink layer Y, magenta ink layer M and cyan ink layer C) and laminate layers 3 in order on the same surface of a substrate 1. As another embodiment, a black ink layer Bk may be formed between the cyan ink layer C and the laminate layer 3 (see FIG. 1(*b*)). FIG. 1(*c*) is a plan view showing still another embodiment of the subliming heat-transfer ink ribbon of the present invention for forming monochromatic black images, which has black ink layers Bk and laminate layers 3 alternately on the same surface of a substrate 1.

The constitution of the laminate layer 3 of the ink ribbon of the present invention may be the same as a conventional laminate layer. As one embodiment shown by FIG. 2(*a*), the laminate layer 3 may be composed of a releasing protective layer 3*a* and an adhesive layer 3*b* laminated in order on the substrate 1. As another embodiment shown by FIG. 2(*b*), the laminate layer 3 may be composed of a releasing protective layer 3*a*, a protective film 3*c* and an adhesive layer 3*b* laminated in order on the substrate 1. For the materials of the layers constituting the laminate layer 3 and the thickness of each constitutive layer, those of the laminate layer in a known subliming heat-transfer ink ribbon may be referred to.

The material and the thickness of the substrate 1 are not specifically defined. For example, preferably used are films of polyesters, polyamides, polyimides, triacetates and the like having a thickness of from 3 to 20 μm or so.

Figure 2A:
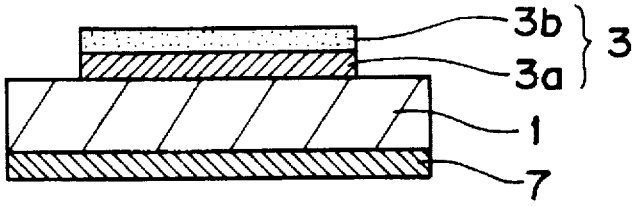
FIG. 2(*a*) is an enlarged cross-sectional view showing one embodiment of the laminate layer of the subliming heat-transfer ink ribbon of the present invention.
Figure 2B:
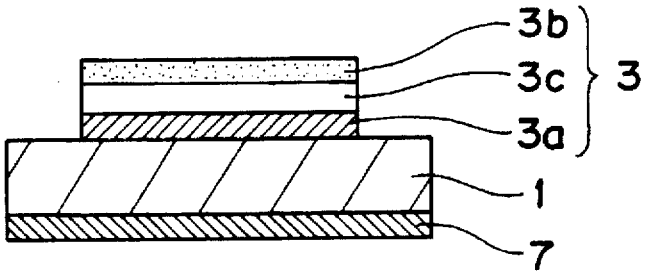
Figure 3A:
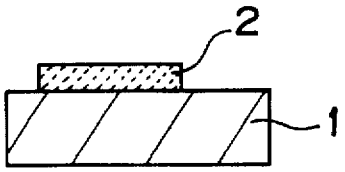
FIG. 3(*a*) is a cross-sectional view showing one conventional subliming heat-transfer ink ribbon.
Figure 3B:
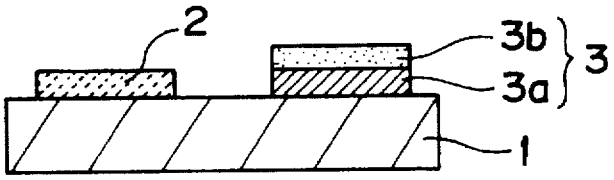
Figure 4:
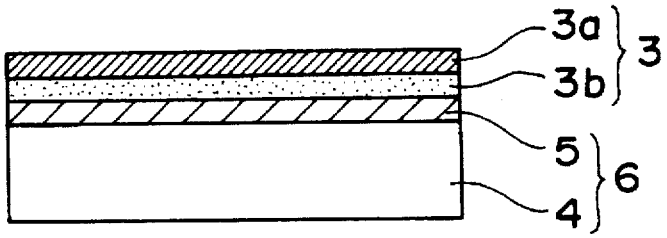
FIG. 4 is a cross-sectional view showing the condition of a printing paper, of which the dye-receiving layer has a laminate layer transferred thereonto.

If desired, a heat-resistant lubricant layer 7 may be provided on the other surface of the substrate 1 coated with the ink layers and the laminate layers, by which the heat sealing between the ink ribbon and a heating means such as a thermal head or the like is prevented (see FIG. 2(*a*) and FIG. 2(*b*)).

The ink layer 2 is characterized by containing a releasing resin as the binder resin therein. Since a releasing resin is added to the ink layers Y, M and C as the binder resin, the blocking between the dye-receiving layer of printing paper that has not been made releasable and the ink ribbon of the present invention is effectively prevented. Therefore, any conventional releasing treatment of the dye-receiving layer of printing paper, to which the ink ribbon of the present invention is applied, can be omitted, and the laminate layers 3 of the ink ribbon of the present invention can be uniformly transferred onto the dye-receiving layer of printing paper that has not been made releasable.

As the releasing resin, especially preferably used is a silicone-modified polyvinyl acetal resin. This resin is prepared by introducing and fixing segments derived from silicone compounds, which are known to have excellent releasability, into a polyvinyl acetal resin which is highly compatible with thermally-diffusing dyes and can realize high recording densities. Therefore, this resin has the excellent properties of these two, silicone compound and polyvinyl acetal resin. In addition, since the silicone compound has been fixed in the polyvinyl acetal resin in this silicone-modified polyvinyl acetal resin, the ink layers containing this resin do not bleed out or the dyes in the ink layers do not crystallize out.

The silicone-modified polyvinyl acetal resin can be obtained by reacting a polyvinyl acetal resin and a silicone compound. In this case, if the ratio of the silicone compound to the polyvinyl acetal resin is too small, the releasability of the ink ribbon containing the modified resin from recording paper that has not been made releasable is poor. If, however, it is too large, the storability of the ink ribbon containing the modified resin is poor and the thermally-diffusing dyes to be in the ink layer of the ink ribbon crystallize out in the ink layer with the result that the densities of the images recorded are lowered. For these reasons, therefore, the proportion of the silicone compound is preferably from 0.1 to 4.5% by weight, more preferably from 0.5 to 3.0% by weight.

As preferred examples of the polyvinyl acetal resin which is the starting material to produce the silicone-modified polyvinyl acetal resin, mentioned are simple polyvinyl acetal resins such as polyvinyl formacetal resins, polyvinyl acetacetal resins, polyvinyl butyracetal resins, etc., and mixed polyvinyl acetal resins such as acetacetal-butyracetal mixed polyvinyl acetal resins, formacetal-acetacetal-butyracetal mixed polyvinyl acetal resins, etc. These can be used singly or as their mixtures. Of these, especially preferred are polyvinyl acetacetal resins in view of the compatibility of the resins with thermally-diffusing dyes and of the recording densities of images to be formed.

These polyvinyl acetal resins are obtained by acetallizing polyvinyl alcohol resins (hereinafter referred to as PVA) by ordinary methods, and said PVA are obtained by saponifying homopolymers of monomers of vinyl esters of fatty acids or copolymers of said monomers and other copolymerizable monomers.

The degree of acetallization of these polyvinyl acetal resins is not specifically defined. In general, however, it is 60% by weight or more, preferably 75% by weight or more, more preferably 85% by weight or more, in view of the compatibility of the resins with thermally-diffusing dyes and of the recording densities of images to be formed.

The other moieties (non-acetallized moieties) than the acetallized moiety in the polyvinyl acetal resins for use in the present invention correspond to the unit moiety of vinyl alcohols derived from the starting material of polyvinyl alcohol resins, and the unit moiety of vinyl esters of fatty acids. Where saponified products of copolymers of vinyl esters of fatty acids and copolymerizable other monomers are used as the starting PVA or where post-modified PVA are used, the non-acetallized moieties of the polyvinyl acetal resins contain additional unit moieties derived from said comonomers or from the compounds for said post-modification, in addition to the above-mentioned two unit moieties.

The mean polymerization degree of the polyvinyl acetal resins for use in the present invention is not specifically defined, but in general, it is preferably from 200 to 4000, more preferably from 300 to 3000. If the mean polymerization degree is less than 200, the power of the resins to ensure the shape of the ink layer and to make the ink layer firmly fixed onto the substrate of the ink ribbon is poor. On the other hand, if it is more than 4000, the solubility of the resins in organic solvents is lowered and the viscosity of the reaction liquid to be acetallized is lowered. In the latter case, the concentration of the reaction system must be lowered. If so, the producibility of the resins is often lowered.

To acetallize PVA, any of the following methods may be employed. ① A solvent method where PVA is dispersed in an organic solvent such as an alcohol or the like, an aldehyde is added thereto in the presence of an acid catalyst such as hydrochloric acid, sulfuric acid or the like to make PVA acetallized, and water is added to the solution containing the resulting polyvinyl acetal resin, thereby precipitating said resin; ② an aqueous mediate method where an aldehyde and an acid catalyst are added to an aqueous solution of PVA to make PVA acetallized, thereby precipitating the resulting polyvinyl acetal resin in the aqueous reaction system in accordance with the procedure of the reaction; and ③ a uniform method where an aldehyde and an acid catalyst are added to an aqueous solution of PVA to make PVA acetallized, while adding an organic solvent to the reaction system in accordance with the procedure of the reaction to thereby make the reaction system uniform and maintain the uniform reaction system.

As the silicone compounds to be used for modifying polyvinyl acetal resins, preferred are organosiloxanes having at least one functional group selected from isocyanato groups, epoxy groups and amino groups at any of the side chains and one or both ends of the molecule. As examples of such silicone compounds, mentioned are those of the following formulae (1) to (3):

Organosiloxanes having functional group(s) at the side chain(s):

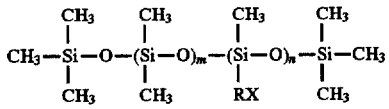

(1)

Organosiloxanes having one functional group at one end:

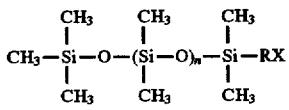

(2)

Organosiloxanes having two functional groups at both ends:

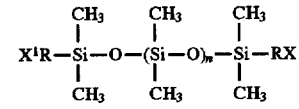

(3)

In the above-mentioned formulae (1), (2) and (3), R represents a lower alkylene group having 10 or less carbon atoms; n and m each independently represent an integer of from 1 to 200; X and $X^1$ each independently represent at least one group selected from the following formulae (4) to (9):

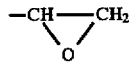

(4)

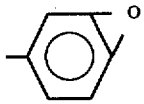

(5)

$-NH_2$ (6)

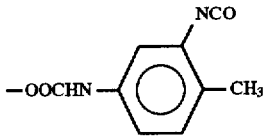

(7)

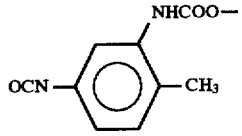

(8)

$-OOCHN(CH_2)_6NCO$ (9)

Commercial products of the above-mentioned compounds can be used in the present invention. If desired, functional silicone compounds to be prepared by introducing at least one of the above-mentioned functional groups into commercial silicone compounds not having any of such functional groups may also be employed in the present invention.

A method for producing silicone-modified polyvinyl acetal resins for use in the present invention is described below.

Silicone-modified polyvinyl acetal resins for use in the present invention can be produced by reacting the moiety of the functional group of any of the above-mentioned silicone compounds and the moiety of the vinyl alcohol unit and/or the moiety of the carboxyl group derived from the post-modification of PVA or the like in a polyvinyl acetal resin. In this method, the ratio of the silicone compound to the polyvinyl acetal resin is preferably such that from 0.1 to 4.5 parts by weight of the silicone compounds are reacted with 100 parts by weight of the polyvinyl acetal resin.

Concretely, a polyvinyl acetal resin is dissolved in an organic solvent, a silicone compound is added thereto all at a time or is dropwise and gradually added thereto and thereafter stirred and mixed for a pre-determined period of time, and the product formed is taken out by filtration. The organic solvent to be used comprises one or more of lower alcohols, esters, ketones, and aromatic and aliphatic hydrocarbons.

While the polyvinyl acetal resin is reacted with the silicone compound, a catalyst of an organic tin compound such as dibutyl tin laurate, dibutyl tin maleate, dioctyl tin laurate or the like may be added, if desired, to the reaction system in order to control the reaction speed.

In the present invention, the ink layer may be formed on the substrate by dissolving or dispersing the binder of the above-mentioned silicone-modified polyvinyl acetal resin, thermally-diffusing dye(s) and optionally various additives in an organic solvent to prepare a composition for forming the ink layer, followed by applying the composition to the substrate 1 by known methods of printing, coating or the like and thereafter drying the thus-coated composition on the substrate 1 to form the intended ink layer thereon.

To prepare the composition for forming the ink layer, it is not always necessary to isolate the silicone-modified polyvinyl acetal resin from the reaction mixture containing the resin but the reaction mixture may be directly mixed with thermally-diffusing dye(s) and optionally various additives only after the resin concentration in the reaction mixture has been suitably adjusted. Alternatively, the silicone-modified polyvinyl acetal resin is first precipitated out and isolated from the reaction mixture containing it, this is washed and dried to be a powdery product, the product is re-dissolved in an organic solvent, and thermally-diffusing dye(s) and optionally various additives are mixed into the resulting solution. In view of the producibility and the production costs, the former is preferred where the resin concentration in the reaction mixture containing the resin is properly adjusted and is directly formulated into the composition for forming the ink layer.

Known thermally-diffusing dyes may be used in the present invention, including, for example, anthraquinone dyes, azo dyes, methine dyes, etc. The additives which are optionally added to the ink composition may be known ones, including, for example, dispersing agents of various surfactants, drying accelerating agents of cellulose derivatives, various defoaming agents, etc.

The proportions of the ingredients constituting the ink layer 2 are referred to. If the proportion of the silicone-modified polyvinyl acetal resin is too small, the releasability of the ink layer is insufficient. However, if it is too large, the amount of the thermally-diffusing dye(s) is relatively lowered with the result that the density of the image to be formed is lowered. Therefore, it is preferred that the content of the silicone-modified polyvinyl acetal resin in the ink layer is approximately from 3 to 80% by weight, more preferably approximately from 20 to 50% by weight. The amount of the silicone-modified polyvinyl acetal resin is preferably approximately from 3 to 200% by weight, more preferably approximately from 50 to 150% by weight, relative to the amount of the thermally-diffusing dye(s) in the ink layer.

The thickness of the ink layers Y, C and M is not specifically defined but, in general, it is preferably approximately from 0.5 to 5 μm.

The subliming heat-transfer ink ribbon of the present invention can be produced by known methods, except that the ink layers 2 are formed in the manner as specifically mentioned hereinabove. For example, the laminate layers such as those shown by FIG. 2(*a*) and FIG. 2(*b*) are formed separately from the ink layers 2 but on the same surface of one substrate, by known methods using known materials. In this way, the subliming heat-transfer ink ribbon of the present invention is produced.

The subliming heat-transfer ink ribbon of the present invention has ink layers each containing a releasing resin as the binder. Therefore, where the ink ribbon is used for thermal sublimation transfer recording, it can be applied even to printing paper having a dye-receiving layer that has not been made releasable or that has been made releasable but only slightly, while preventing the heat sealing between the printing paper and the ink ribbon. In addition, by using the ink ribbon of the present invention, it is possible to uniformly transfer the laminate layers of the ink ribbon onto the dye-receiving layer of printing paper even at lower energy. In particular, where the ink ribbon of the present invention is applied to printing paper having a dye-receiving layer that has not been made releasable or that has been made releasable but only slightly, it is easy to surely transfer the laminate layers onto the printing paper even though the adhesiveness of the laminate layers is lowered. Therefore, the margin of the adhesiveness of the laminate layers can be broadened.

The present invention is described in detail hereinunder by means of the following examples, which, however, are not intended to restrict the scope of the present invention.

The following referential examples 1 to 11 are to demonstrate the production of silicone-modified polyvinyl acetal resins and silicone compound-mixed polyvinyl acetal resins which are used in the following examples and comparative examples.

Unless otherwise specifically indicated, all "parts" and "%" are by weight.

REFERENTIAL EXAMPLE 1

Production of silicone compound modified with isocyanato group (A) at one end:

108 parts of toluene, 100 parts of silicone oil modified with hydroxyl group at one end (X-22-170B having a hydroxyl equivalent of 2200, produced by Shin-etsu Chemical Co.) and one part of dibutyl tin laurate were put into a reactor equipped with a stirrer, a reflux condenser and a thermometer. 8 parts of 2,6-tolylene diisocyanate (TDI) were added thereto. These were reacted at 60° C. for 4 hours and then cooled to obtain a solution of silicone compound modified with isocyanato group (A) at one end, which is shown in Table 1 below.

Production of silicone-modified polyvinyl acetacetal resin:

450 parts of toluene were put into a reactor equipped with a stirrer, a reflux condenser and a thermometer, and 100 parts of the polyvinyl acetacetal resin shown in Table 2 below (having a polymerization degree of 2430, an acetacetal moiety content of 90.0%, a vinyl alcohol moiety content of 8.5%, and a vinyl acetate moiety content of 1.5%) were added thereto and dissolved with stirring at 60° C. over a period of 2 hours. Next, one part of dibutyl tin laurate and 5 parts of the solution of silicone compound modified with isocyanato group (A) at one end were added thereto and reacted at 60° C. for 4 hours. The resulting solution was diluted with 450 parts of methyl ethyl ketone and cooled to obtain a solution of silicone-modified polyvinyl acetacetal resin. The silicone segment content (degree of silicone modification) of the thus-obtained silicone-modified polyvinyl acetacetal resin is shown in Table 3 below.

The composition of the polyvinyl acetacetal resin was analyzed according to JIS-K6728. To determine the silicone segment content (degree of silicone modification) of the silicone-modified polyvinyl acetal resin obtained herein, a sample of the resin was incinerated in a platinum crucible and then treated with a hydrofluoric acid, and the reduced amount was measured in terms of $SiO_2$.

REFERENTIAL EXAMPLE 2

Production of silicone compound modified with isocyanato group (A) at both ends:

170 parts of toluene, 100 parts of silicone oil modified with hydroxyl group at both ends (X-22-160AS having a hydroxyl equivalent of 250, produced by Shin-etsu Chemical Co.) and one part of dibutyl tin laurate were put into a reactor equipped with a stirrer, a reflux condenser and a thermometer. 70 parts of 2,6-tolylene diisocyanate (TDI) were added thereto. These were reacted at 60° C. for 4 hours and then cooled to obtain a solution of silicone compound modified with isocyanato group (A) at both ends.

Production of silicone-modified polyvinyl acetacetal resin:

A solution of silicone-modified polyvinyl acetacetal resin was prepared in the same manner as in Referential Example 1, except that a solution of silicone compound modified with isocyanato group (A) at both ends was used as the silicone compound and that the polyvinyl acetacetal resin shown in Table 2 was used. The silicone segment content of the thus-obtained silicone-modified polyvinyl acetacetal resin is shown in Table 3.

REFERENTIAL EXAMPLE 3

Production of silicone compound modified with isocyanato group (A) at the side chains:

108 parts of toluene, 100 parts of silicone oil modified with hydroxyl group at the side chains (X-22-4015 having a hydroxyl equivalent of 2100, produced by Shin-etsu Chemical Co.) and one part of dibutyl tin laurate were put into a reactor equipped with a stirrer, a reflux condenser and a thermometer. 8 parts of 2,6-tolylene diisocyanate (TDI) were added thereto. These were reacted at 60° C. for 4 hours and then cooled to obtain a solution of silicone compound modified with isocyanato group (A) at the side chains.

Production of silicone-modified polyvinyl acetacetal resin:

A solution of silicone-modified polyvinyl acetacetal resin was prepared in the same manner as in Referential Example 1, except that a solution of silicone compound modified with isocyanato group (A) at the side chains was used as the silicone compound and that the polyvinyl acetacetal resin shown in Table 2 was used. The silicone segment content of the thus-obtained silicone-modified polyvinyl acetacetal resin is shown in Table 3.

REFERENTIAL EXAMPLE 4

Production of silicone compound modified with isocyanato group (B) at one end:

108 parts of toluene, 100 parts of silicone oil modified with hydroxyl group at the side chains (X-22-4015 having a hydroxyl equivalent of 2100, produced by Shin-etsu Chemical Co.) and one part of dibutyl tin laurate were put into a reactor equipped with a stirrer, a reflux condenser and a thermometer. 8 parts of hexamethylene diisocyanate (HDI) were added thereto. These were reacted at 60° C. for 4 hours and then cooled to obtain a solution of silicone compound modified with isocyanato group (B) at one end.

Production of silicone-modified polyvinyl acetacetal resin:

A solution of silicone-modified polyvinyl acetacetal resin was prepared in the same manner as in Referential Example 1, except that a solution of silicone compound modified with isocyanato group (B) at one end was used as the silicone compound and that the polyvinyl acetacetal resin shown in Table 2 was used. The silicone segment content of the thus-obtained silicone-modified polyvinyl acetacetal resin is shown in Table 3.

REFERENTIAL EXAMPLE 5

Silicone compound modified with amino group at both ends:

X-22-161AS (having an amino equivalent of 450), produced by Shin-etsu Chemical Co. was used as the silicone compound modified with amino group at both ends.

Production of silicone-modified polyvinyl acetacetal resin:

Silicone-modified polyvinyl acetacetal resin was prepared in the same manner as in Referential Example 1, except that the above-mentioned silicone compound modified with amino group at both ends was used and that the polyvinyl acetacetal resin shown in Table 2 was used. The silicone segment content of the thus-obtained silicone-modified polyvinyl acetacetal resin is shown in Table 3.

REFERENTIAL EXAMPLE 6

Silicone compound modified with epoxy group (A) at one end:

X-22-137B (having an epoxy equivalent of 2500), produced by Shin-etsu Chemical Co. was used as the silicone compound modified with epoxy group (A) at one end.

Production of silicone-modified polyvinyl acetacetal resin:

Silicone-modified polyvinyl acetacetal resin was prepared in the same manner as in Referential Example 1, except that the above-mentioned silicone compound modified with epoxy group (A) at one end was used and that the polyvinyl acetacetal resin shown in Table 2 was used. The silicone segment content of the thus-obtained silicone-modified polyvinyl acetacetal resin is shown in Table 3.

REFERENTIAL EXAMPLE 7

Silicone compound modified with epoxy group (B) at the side chains:

KF-102 (having an epoxy equivalent of 4000), produced by Shin-etsu Chemical Co. was used as the silicone compound modified with epoxy group (B) at the side chains.

Production of silicone-modified polyvinyl acetacetal resin:

Silicone-modified polyvinyl acetacetal resin was prepared in the same manner as in Referential Example 1, except that the above-mentioned silicone compound modified with epoxy group (B) at the side chains was used and that the polyvinyl acetacetal resin shown in Table 2 was used. The silicone segment content of the thus-obtained silicone-modified polyvinyl acetacetal resin is shown in Table 3.

REFERENTIAL EXAMPLES 8, 9 AND 10

Silicone-modified polyvinyl acetacetal resins were prepared in the same manner as in Referential Example 1, except that a varying amount of the silicone compound modified with isocyanato group (A) at one end, which had been prepared in Referential Example 1, was used and that the polyvinyl acetacetal resin shown in Table 2 was used. The silicone segment content of each of the thus-obtained silicone-modified polyvinyl acetacetal resins is shown in Table 3.

REFERENTIAL EXAMPLE 11

450 parts of toluene and 450 parts of methyl ethyl ketone were put into a reactor equipped with a stirrer, a reflux condenser and a thermometer, and 1000 parts of the polyvinyl acetacetal resin shown in Table 2 were added thereto and dissolved with stirring at 60° C. over a period of 2 hours. Next, 2.5 parts of Silicone Oil KF-96 (produced by Shin-etsu Chemical Co.) having no functional group were added thereto and mixed at 60° C. for 4 hours. This was cooled to obtain a solution of silicone-mixed polyvinyl acetacetal resin.

REFERENTIAL EXAMPLE 12

The polyvinyl acetacetal resin shown in Table 2 was prepared, which was neither modified nor mixed with silicone.

TABLE 1

Silicone Compounds Used

| | Functional Group | Position of Functional Group | Equivalent of Functional Group (g/mol) |
|---|---|---|---|
| Referential Example 1 | isocyanato group (A) | one end | 2200 |
| Referential Example 2 | isocyanato group (A) | both ends | 250 |
| Referential Example 3 | isocyanato group (A) | side chains | 2100 |
| Referential Example 4 | isocyanato group (B) | one end | 2200 |
| Referential Example 5 | amino group | both ends | 450 |
| Referential Example 6 | epoxy group (A) | one end | 2500 |
| Referential Example 7 | epoxy group (B) | side chains | 4000 |
| Referential Example 8 | isocyanato group (A) | one end | 2200 |
| Referential Example 9 | isocyanato group (A) | one end | 2200 |
| Referential Example 10 | isocyanto group (A) | one end | 2200 |
| Referential Example 11 | (Silicone oil with no functional group added: 2.5%) | | 2200 |
| Referential Example 12 | (Not used) | — | — |

Isocyanato group (A), isocyanato group (B), epoxy group (A) and epoxy group (B) referred to in Table 1 are shown below. The equivalent of functional group as referred to in Table 1 indicates time molecular weight of one functional group unit.

Isocyanato group (A):

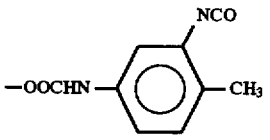

(7)

Isocyanato group (B):

$$-OOCHN(CH_2)_6NCO \quad (8)$$

Epoxy group (A):

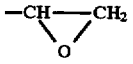

(9)

Epoxy group (B):

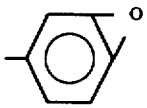

(10)

TABLE 2

Polyvinyl Acetacetal Resins Used

| | Vinyl Alcohol Moiety Content (%) | Vinyl Acetate Moiety Content (%) | Acetacetal Moiety Content (%) | Acrylic Acid Moiety Content (%) | Degree of Polymerization |
|---|---|---|---|---|---|
| Referential Example 1 | 8.5 | 1.5 | 90.0 | — | 2430 |
| Referential Example 2 | 8.8 | 2.5 | 88.7 | — | 2430 |
| Referential Example 3 | 8.4 | 1.8 | 89.7 | — | 2430 |
| Referential Example 4 | 9.1 | 2.0 | 88.9 | — | 2430 |
| Referential Example 5 | 9.9 | 13.3 | 75.3 | 1.5 | 2470 |
| Referential Example 6 | 8.6 | 12.6 | 77.3 | 1.4 | 2470 |
| Referential Example 7 | 9.2 | 13.0 | 76.2 | 1.6 | 2470 |
| Referential Example 8 | 8.7 | 2.1 | 89.2 | — | 2430 |
| Referential Example 9 | 8.4 | 1.6 | 90.0 | — | 2430 |
| Referential Example 10 | 8.2 | 1.6 | 90.2 | — | 2430 |
| Referential Example 11 | 8.8 | 1.3 | 89.9 | — | 2430 |
| Referential Example 12 | 8.5 | 1.5 | 90.0 | — | 2430 |

TABLE 3

| | Degree of Silicone Modification (%) |
|---|---|
| Referential Example 1 | 2.5 |
| Referential Example 2 | 2.4 |
| Referential Example 3 | 2.6 |
| Referential Example 4 | 2.3 |
| Referential Example 5 | 2.5 |
| Referential Example 6 | 2.6 |
| Referential Example 7 | 2.3 |
| Referential Example 8 | 0.1 |
| Referential Example 9 | 4.3 |
| Referential Example 10 | 4.8 |
| Referential Example 11 | — |
| Referential Example 12 | — |

EXAMPLES 1 TO 10 AND COMPARATIVE EXAMPLES 1 AND 2

Formation of Ink Ribbons:

The composition for forming a heat-resistant lubricant layer, shown in Table 4 below, was coated on one surface of a 6-μm polyester film base, using a wire bar, and then dried to form a heat-resistant lubricant layer thereon having a dry thickness of 1 μm.

TABLE 4

Composition for Forming Heat-resistant Lubricant Layer

| Components | Amount Added (%) |
|---|---|
| Polyvinyl butyral resin (BX55Z, produced by Sekisui Chemical Co., Ltd.) | 5.6 |
| Phosphate (Plysurf A208S, produced by Dai-ichi Kogyo Seiyaku Co., Ltd.) | 1.1 |

TABLE 4-continued

| Composition for Forming Heat-resistant Lubricant Layer | |
|---|---|
| Components | Amount Added (%) |
| Calcium Carbonate (Hakuen-ka DD, produced by Shiraishi Kogyo Kaisha, Ltd.) | 1.1 |
| Isocyanate-type crosslinking agent (Colonate L, produced by Nippon Polyurethane Industry Co., Ltd.) | 2.2 |
| Methyl ethyl ketone | 45.0 |
| Toluene | 45.0 |

Next, using any one of the silicone-modified polyvinyl acetacetal resins obtained in Referential Examples 1 to 12 as the binder in the composition shown in Table 5 below, compositions for forming ink layers were prepared. Each of the thus-obtained compositions was coated on the other surface of the polyester film base, using a wire bar, and dried to form thereon an ink layer having a dry thickness of 1 μm.

TABLE 5

| Composition for Forming Ink Layer | |
|---|---|
| Components | Amount Added (%) |
| Binder (Example No. or Comparative Example No.) | 3.0 |
| Referential Example 1 (Example 1) | |
| Referential Example 2 (Example 2) | |
| Referential Example 3 (Example 3) | |
| Referential Example 4 (Example 4) | |
| Referential Example 5 (Example 5) | |
| Referential Example 6 (Example 6) | |
| Referential Example 7 (Example 7) | |
| Referential Example 8 (Eyample 8) | |
| Referential Example 9 (Example 9) | |
| Referential Example 10 (Example 10) | |
| Referential Example 11 (Comparative Example 1) | |
| Referential Example 12 (Comparative Example 2) | |
| Magenta dyes | |
| ESC Bordeux 451 (produced by Sumitomo Chemical Co.) | 2.5 |
| HSR2031 (produced by Mitsubishi Kasei Corp.) | 2.5 |
| Methyl ethyl ketone | 45.0 |
| Toluene | 45.0 |

Next, the composition for forming a releasing protective layer, shown in Table 6 below, was coated on the same surface of the polyester film base but separately from the ink layer coated thereon, using a wire bar, and dried to form a releasing protective layer having a dry thickness of 3 μm.

TABLE 6

| Composition for Forming Releasing Protective Layer | |
|---|---|
| Components | Amount Added (%) |
| Polymethyl methacrylate (Paraloid A-11, produced by Rhom & Haas Co.) | 20 |
| Methyl ethyl ketone | 40 |
| Toluene | 40 |

The composition A or B for forming an adhesive layer, shown in Table 7 or 8 below, was coated and dried on the releasing protective layer to form thereon an adhesive layer having a dry thickness of 3 μm. In this way, obtained were two subliming heat-transfer ink ribbon samples each having thereon a laminate layer composed of the releasing protective layer and the adhesive layer. Concretely, one sample had the adhesive layer of the composition A (Example 1-A), while the other sample had the adhesive layer of the composition B (Example 1-B).

TABLE 7

| Composition A for Forming Adhesive Layer | |
|---|---|
| Components | Amount Added (%) |
| Cellulose acetate butyrate resin (CAB551-0.01, produced by Eastman Chemical Products Inc.) | 20 |
| Methyl ethyl ketone | 40 |
| Toluene | 40 |

TABLE 8

| Composition B for Forming Adhesive Layer | |
|---|---|
| Components | Amount Added (%) |
| Vinyl chloride-vinyl acetate copolymer (Denkavinyl #1000D, produced by DENKI KAGAKU KOGYO CO., LTD.) | 18 |
| Ultraviolet absorbent (Sessorb 702, produced by SHIPRO KASEI KAISHA, LTD.) | 2 |
| Methyl ethyl ketone | 40 |
| Toluene | 40 |

Apart from the above-mentioned ink ribbon samples, printing paper samples (a) to (e) were prepared. Concretely, the compositions (a) to (e) for forming dye-receiving layers, shown in Tables 9 to 13, respectively, each were coated on the base for printing paper (60-μm synthetic paper (YUPO, produced by OJI-YUKA SYNTHETIC PAPER CO., LTD.) /60-μm lightweight coated paper/60-μm synthetic paper (YUPO, produced by OJI-YUKA SYNTHETIC PAPER CO., LTD.)), using a wire bar, and dried to form thereon a dye-receiving layer having a dry thickness of 5 μm. Printing paper samples (a) to (e) thus prepared had the compositions (a) to (e), respectively.

TABLE 9

| Composition (a) for Forming Dye-receiving Layer (containing releasing agent) | |
|---|---|
| Components | Amount Added (%) |
| Cellulose acetate butyrate resin (CAB551-0.2, produced by Eastman Chemical Products Inc.) | 15.2 |
| Fluorescent brightening agent (Ubitex-OB, produced by Ciba-Geigy Co.) | 0.1 |
| Dicyclohexyl phthalate | 3.1 |
| Polyisocyanate (Takenate D110N, produced by Takeda Chemical Industries, Co.) | 0.8 |
| Alcohol-modified silicone oil (releasing agent) (SF8427, produced by Toray Dow Corning Silicone Co.) | 0.8 |
| Methyl ethyl ketone | 40.0 |
| Toluene | 40.0 |

TABLE 10

Composition (b) for Forming Dye-receiving Layer (containing releasing agents)

| Components | Amount Added (%) |
|---|---|
| Vinyl chloride-vinyl acetate copolymer (Denkavinyl #1000AKT, produced by DENKI KAGAKU KOGYO CO., LTD) | 8.0 |
| Polyester resin (Vylon #600, produced by TOYOBO CO., LTD.) | 2.0 |
| Amino-modified silicone (releasing agent) (KF393, produced by Shin-etsu Chemical Co., Ltd.) | 0.5 |
| Epoxy-modified silicone (releasing agent) | 0.5 |
| Methyl ethyl ketone | 44.5 |
| Toluene | 44.5 |

TABLE 11

Composition (c) for Forming Dye-receiving Layer (containing no releasing agent)

| Components | Amount Added (%) |
|---|---|
| Cellulose acetate butyrate resin (CAB551-0.2, produced by Eastman Chemical Products Inc.) | 16.0 |
| Fluorescent brightening agent (Ubitex-OB, produced by Ciba-Geigy Co.) | 0.1 |
| Dicyclohexyl phthalate | 3.1 |
| Polyisocyanate (Takenate D110N, produced by Takeda Chemical Industries, Co.) | 0.8 |
| Methyl ethyl ketone | 40.0 |
| Toluene | 40.0 |

TABLE 12

Composition (d) for Forming Dye-receiving Layer (containing no releasing agent)

| Components | Amount Added (%) |
|---|---|
| Vinyl chloride-vinyl acetate copolymer (Denkavinyl #1000AKT, produced by DENKI KAGAKU KOGYO CO., LTD.) | 9.0 |
| Polyester resin (Vylon #600, produced by TOYOBO CO., LTD.) | 2.0 |
| Methyl ethyl ketone | 44.5 |
| Toluene | 44.5 |

TABLE 13

Composition (e) for Forming Dye-receiving Layer (containing releasing agent)

| Components | Amount Added (%) |
|---|---|
| Cellulose acetate butyrate resin (CAB551-0.2, produced by Eastman Chemical Products Inc.) | 15.9 |
| Fluorescent brightening agent (Ubitex-OB, produced by Ciba-Geigy Co.) | 0.1 |
| Dicyclohexyl phthalate | 3.2 |
| Polyisocyanate (Takenate D110N, produced by Takeda Chemical Industries, Co.) | 0.4 |
| Alcohol-modified silicone oil (releasing agent) (SF8427, produced by Toray Dow Corning Co.) | 0.4 |

TABLE 13-continued

Composition (e) for Forming Dye-receiving Layer (containing releasing agent)

| Components | Amount Added (%) |
|---|---|
| Methyl ethyl ketone | 40.0 |
| Toluene | 40.0 |

Note: The content of the releasing agent in the composition (e) is a half of that of the releasing agent in the composition (a).

Next, the ink ribbon samples produced in the above-mentioned examples and comparative examples were subjected to a peel test and a storage stability test, which are mentioned below, to evaluate the releasability and the storage stability of the ink layers in these samples. In addition, the ink ribbon samples produced in Example 1 were subjected to an adhesion test, which is mentioned below, to evaluate the adhesiveness of the laminate layers in these samples.

Peel test for ink ribbon samples:

Using a full-color printer (UP-D7000, produced by Sony Co.), on which any one of the ink ribbon samples produced in the above-mentioned examples and comparative examples had been mounted, solid images were printed on the above-mentioned printing paper samples (a) to (e), whereupon the releasability of the ink layer in each ink ribbon sample from the dye-receiving layer in each printing paper sample was checked. The releasability of the ink layer from the dye-receiving layer was evaluated on the basis of the following criteria. The results obtained are shown in Table 14 below.

Evaluation of releasability of ink layer:

| Rank | Condition |
|---|---|
| ⊙: | Not adhered by fusion. The ink ribbon was peeled smoothly with giving no sound. |
| O: | Not adhered by fusion. When the ink ribbon was peeled, it gave some little sound, which, however causes no problem for the practical use of the ink ribbon. |
| X: | Adhered by fusion. |

Test for storage stability of ink ribbon samples:

The ink ribbon samples produced in the above-mentioned examples and comparative examples were stored at 50° C. and 80% RH for 48 hours. The thus-stored samples were checked as to whether or not the dyes bled and/or crystallized, with the naked eye. The storage stability of the ink layer of each ink ribbon sample was evaluated on the basis of the following criteria. The results obtained are shown in Table 14.

Evaluation of storage stability of ink layer:

| Rank | Condition |
|---|---|
| ⊙: | No change was seen in the stored sample. |
| O: | Some crystals of dyes appeared partly on the |

-continued

| Rank | Condition |
|---|---|
| | surface of the ink layer, which, however cause no problem for the practical use of the ink ribbon. |
| X: | Crystals of duds appeared on the whole surface of the ink layer. |

Adhesion test for laminate layer:

The ink ribbon sample of Example 1-A (having the adhesive layer of the composition A) was put onto each of the printing paper samples (a) to (e), while applying thereto energy of 80% of the energy for solid printing the dye-receiving layer. In the same manner, the ink ribbon sample of Example 1-B (having the adhesive layer of the composition B) was put onto each of the printing paper samples (a) to (e). The adhesiveness of the laminate layer of each ink ribbon sample to the dye-receiving layer of each printing paper sample was evaluated on the basis of the following criteria. The results obtained are shown in Table 15 below.

Evaluation of adhesiveness of laminate layer:

| Rank | Condition |
|---|---|
| ⊙: | The laminate layer adhered firmly and uniformly to the dye-receiving layer. |
| O: | The laminate layer adhered firmly to the dye-receiving layer, but the edges of the laminate layer became somewhat roughened (namely the edges were not completely straight). However, the ink ribbon has no problem in its practical use. |
| X: | The laminate layer was easily peeled, when fingered. |

TABLE 14

| Printing | Peel Test | | | | | Storage |
|---|---|---|---|---|---|---|
| Paper | a | b | c | d | e | Stability Test |
| Example 1 | ⊙ | ⊙ | ⊙ | ⊙ | ⊙ | ⊙ |
| Example 2 | ⊙ | ⊙ | ⊙ | ⊙ | ⊙ | ⊙ |
| Example 3 | ⊙ | ⊙ | ⊙ | ⊙ | ⊙ | ⊙ |
| Example 4 | ⊙ | ⊙ | ⊙ | ⊙ | ⊙ | ⊙ |
| Example 5 | ⊙ | ⊙ | ⊙ | ⊙ | ⊙ | ⊙ |
| Example 6 | ⊙ | ⊙ | ⊙ | ⊙ | ⊙ | ⊙ |
| Example 7 | ⊙ | ⊙ | ⊙ | ⊙ | ⊙ | ⊙ |
| Example 8 | ⊙ | ⊙ | O | O | O | ⊙ |
| Example 9 | ⊙ | ⊙ | ⊙ | ⊙ | ⊙ | ⊙ |
| Example 10 | ⊙ | ⊙ | ⊙ | ⊙ | ⊙ | O |
| Comparative Example 1 | ⊙ | ⊙ | ⊙ | ⊙ | ⊙ | X |
| Comparative Example 2 | ⊙ | ⊙ | X | X | X | ⊙ |

TABLE 15

| Test for Adhesiveness of Laminate Layer | | |
|---|---|---|
| Printing | Composition of Adhesive Layer | |
| Paper | A | B |
| a | X | X |
| b | X | X |
| c | ⊙ | ⊙ |

TABLE 15-continued

| Test for Adhesiveness of Laminate Layer | | |
|---|---|---|
| Printing | Composition of Adhesive Layer | |
| Paper | A | B |
| d | ⊙ | ⊙ |
| e | O | O |

The subliming heat-transfer ink ribbon samples of the present invention (Examples 1 to 10) all had excellent releasability and storage stability irrespective of the degree of the releasing treatment of printing paper to which they were applied, as shown in Table 14. In addition, the laminate layers of these ink ribbon samples (Examples 1 to 10) were all transferred and fixed firmly onto even the printing paper samples (c) and (d) containing no releasing agent and also the printing paper sample (e) containing only a small amount of a releasing agent, as shown in Table 15.

From these results, it is known that the subliming heat-transfer ink ribbon samples of the present invention did not stick to the printing paper samples not containing a releasing agent or containing only a small amount of a releasing agent, under heat for thermal transfer, and that the laminate layer of each of said ink ribbon samples was satisfactorily transferred onto the color image formed on said printing paper samples.

As opposed to these, the storability of the subliming heat-transfer ink ribbon sample of Comparative Example 1 was bad although its releasability from any of the tested printing paper samples was good, as shown in Table 14. From these results, it is known that the ink ribbon sample of Comparative Example 1 is unsuitable for practical use.

The releasability of the subliming heat-transfer ink ribbon sample of Comparative Example 2 from the printing paper samples (a) and (b) both containing releasing agent(s) was good, but its releasability from the other printing paper samples not containing a releasing agent or containing only a small amount of a releasing agent was poor, as shown in Table 14. From these results, it is understood that the ink ribbon of Comparative Example 2 is not applicable to such printing paper not containing a releasing agent or containing only a small amount of a releasing agent.

As has been described in detail hereinabove, the subliming heat-transfer ink ribbon of the present invention, which has ink layer(s) and laminate layer(s) separately formed on one and the same substrate, is applicable even to printing paper that has not been made releasable or has been made releasable but only slightly so as to form an image on the latter by thermal sublimation transfer recording, while preventing the hot-sealing of the ink ribbon to the printing paper. In addition, the laminate layer(s) of the ink ribbon is/are uniformly transferred onto the dye-receiving layer of printing paper.

While the invention has been described in detail and with reference to specific embodiments thereof, it will be apparent to one skilled in the art that various changes and modifications can be made therein without departing from the spirit and scope thereof.

What is claimed is:

1. An ink ribbon for the thermal sublimation transfer of ink to a surface, the ink ribbon comprising:

a substrate layer accommodating an ink layer and a laminate layer, the ink layer and laminate layer being disposed on separate areas of the substrate, the ink layer comprising a dye suspended in a resin, the resin consisting of a silicone-modified polyvinyl acetal resin, said silicone-modified polyvinyl acetal resin is a reaction product obtained by reacting a polyvinyl acetal resin and a silicone compound having at least one functional group selected from the group consisting of isocyanate, epoxy and amino, said silicone compound is provided in an amount ranging from 0.1% by weight to 4.5% by weight relative to the polyvinyl acetal resin, the laminate layer comprising a release layer and an adhesive layer, the release layer being disposed between the substrate and the adhesive layer.

2. The ink ribbon of claim 1, wherein the polyvinyl acetal resin is characterized as having a degree of acetallization ranging from 60% by weight to 85% by weight.

3. The ink ribbon of claim 1, wherein the polyvinyl acetal resin is characterized as having a polymerization degree ranging from about 200 to about 4,000.

4. The ink ribbon of claim 1, wherein the ink layer comprises from about 3% to about 80% silicone-modified polyvinyl acetal resin.

5. The ink ribbon of claim 1, wherein the ink layer comprises from about 20% to about 50% silicone-modified polyvinyl acetal resin.

6. The ink ribbon of claim 1, wherein the ink layer is characterized as having a thickness ranging from about 0.5 μm to about 5 μm.

7. A method of carrying out thermal sublimation transfer of ink to a surface comprising the following steps:

providing an ink ribbon comprising a substrate layer accommodating an ink layer and a laminate layer, the ink layer and laminate layer being disposed on separate areas of the substrate, the ink layer comprising a dye suspended in a resin, the resin consisting of a silicone-modified polyvinyl acetal resin, said silicone-modified polyvinyl acetal resin is a reaction product obtained by reacting a polyvinyl acetal resin and a silicone compound having at least one functional group selected from the group consisting of isocyanate, epoxy and amino, said silicone compound is provided in an amount ranging from 0.1% by weight to 4.5% by weight relative to the polyvinyl acetal resin, the laminate layer comprising a release layer and an adhesive layer, the release layer being disposed between the substrate and the adhesive layer;

providing a dye-receiving surface that is free of releasing resin;

engaging the dye-receiving surface with the ink layer of the ink ribbon;

heating an undersurface of the substrate of the ink ribbon disposed behind the ink layer to transfer said dye and said resin to the dye-receiving layer to produce an image thereon;

moving the ink ribbon to engage the laminate layer with the image disposed on the dye-receiving surface;

heating the undersurface of the substrate of the ink ribbon disposed behind the laminate layer to transfer the release layer and the adhesive layer onto said image.

* * * * *